US007571590B2

(12) United States Patent
Ilch et al.

(10) Patent No.: US 7,571,590 B2
(45) Date of Patent: Aug. 11, 2009

(54) APPARATUS AND METHOD FOR TRANSPORTING AND DEPOSITING ITEMS INTO A PACKAGE

(75) Inventors: Hartmut Ilch, Kehl (DE); Joachim Schill, Kehl (DE)

(73) Assignee: Maja-Maschinenfabrik Hermann Schill GmbH & Co., Kehl-Goldscheuer (DE)

( * ) Notice: Subject to any disclaimer, the term of this patent is extended or adjusted under 35 U.S.C. 154(b) by 0 days.

(21) Appl. No.: 11/108,097

(22) Filed: Apr. 15, 2005

(65) Prior Publication Data

US 2006/0162293 A1 Jul. 27, 2006

(30) Foreign Application Priority Data

Apr. 16, 2004 (DE) ..... 10 2004 019 124

(51) Int. Cl.
*B65B 35/20* (2006.01)

(52) U.S. Cl. ..... 53/475; 53/244; 53/248; 53/252; 53/258; 53/260

(58) Field of Classification Search ..... 53/244, 53/248, 251, 252, 258, 260, 475, 247, 249, 53/250, 255
See application file for complete search history.

(56) References Cited

U.S. PATENT DOCUMENTS

| | | | | | |
|---|---|---|---|---|---|
| 2,782,577 | A | * | 2/1957 | Beall | 53/501 |
| 3,319,396 | A | * | 5/1967 | Hofer et al. | 53/240 |
| 3,410,050 | A | * | 11/1968 | Bell | 53/538 |
| 3,444,982 | A | * | 5/1969 | Greiner | 198/412 |
| 4,027,459 | A | * | 6/1977 | Nieskens et al. | 53/500 |
| 4,048,784 | A | * | 9/1977 | Toby | 53/77 |
| 4,085,561 | A | * | 4/1978 | Waldrop | 53/473 |
| 4,627,215 | A | * | 12/1986 | Walz | 53/246 |
| 5,010,713 | A | * | 4/1991 | Leander | 53/142 |
| 5,018,338 | A | * | 5/1991 | Jurchuk et al. | 53/532 |
| 6,536,599 | B1 | * | 3/2003 | Nielsen | 209/540 |

FOREIGN PATENT DOCUMENTS

| | | | |
|---|---|---|---|
| CH | 0518541 | | 3/1972 |
| DE | 1204129 | A * | 10/1965 |
| DE | 19821969 | | 5/1998 |
| DE | 29723638 | | 1/1999 |
| DE | 10304773 | | 8/2004 |
| GB | 932098 | A * | 7/1963 |

* cited by examiner

*Primary Examiner*—Stephen F Gerrity
(74) *Attorney, Agent, or Firm*—Orum & Roth LLC

(57) ABSTRACT

An apparatus and method for the controlled depositing of pliable items in a package are hereby proposed. In this process, the items are conveyed to the packing zone on a conveyor belt. The items are captured on the conveyor belt and moved to the edge of the conveyor belt using a gripper on a rotating gripper arm, the axis of rotation of which runs perpendicular to the conveyor belt. From there, the items are pushed onto a plate with the aid of the gripper and conveyed to a position above their intended position in the package. As soon as the position above the package has been reached, the plate is pulled back, thereby enabling the item to fall into the package located underneath. A packaging conveyor system is used to convey the packages to the packing zone and transport them further once an item has been deposited in order to allow the next item to be deposited.

20 Claims, 3 Drawing Sheets

APPARATUS AND METHOD FOR TRANSPORTING AND DEPOSITING ITEMS INTO A PACKAGE

Figure 1:
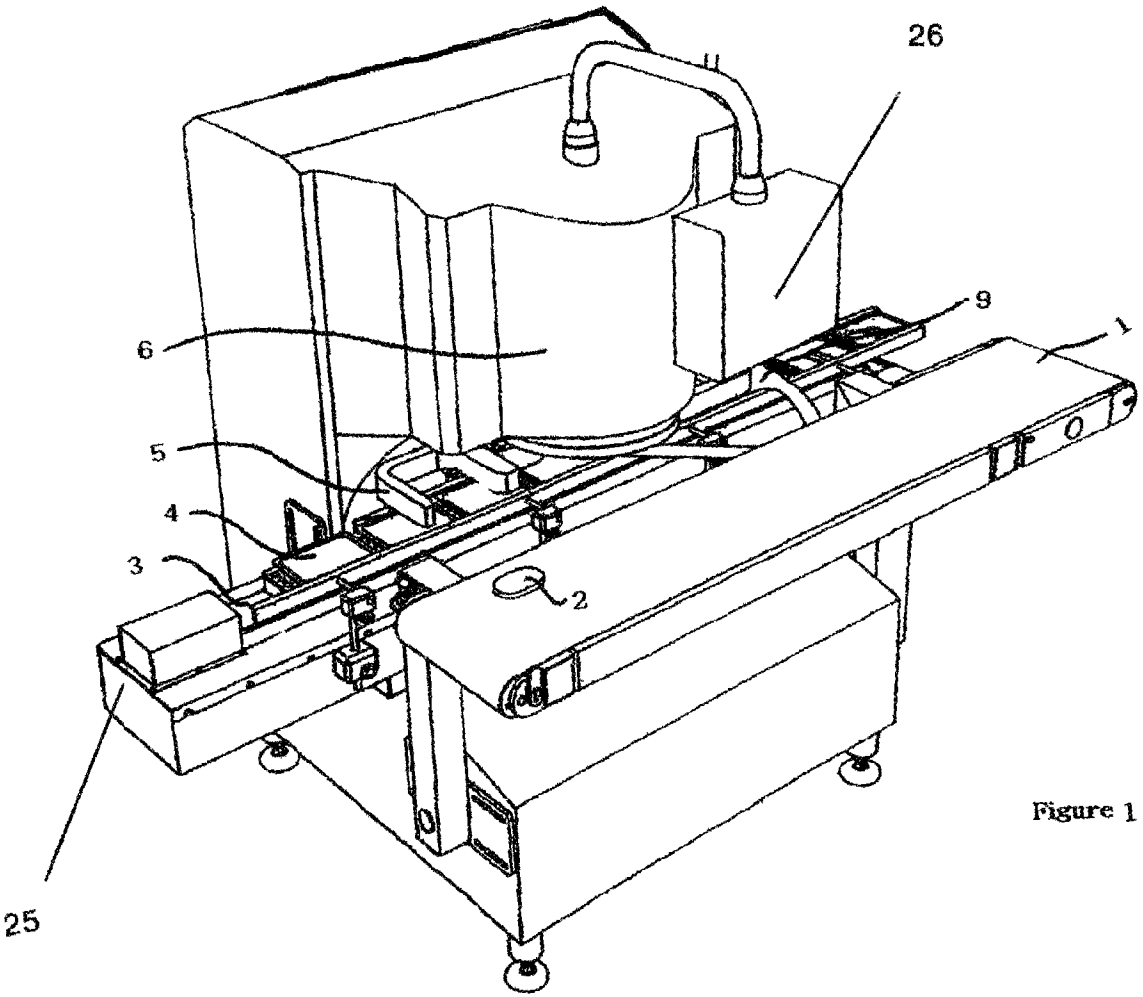

The invention is based on an apparatus and a method for the controlled depositing of pliable items in packages. The items to be packed are conveyed to the packing zone on a conveyor belt. The packages are conveyed to the packing zone by a packaging conveyor system.

One example of a situation where pliable items arise is in food processing or manufacturing. For example, such a situation may involve portions of freshly washed meat, pieces of sausage or cheese, fish fillets, uncooked pieces of dough, hot pastries, or sliced portions of fruit or vegetables. The packaging may comprise packages such as dishes, trays, and thermoform packaging, the top of which is sealed by a lid or covered over with foil. Since food processing is frequently conducted at high speed by machine, it is useful to be able to pack the items at the same speed. However, due to their consistency and surface texture, the pliable items have the disadvantage that they can neither be directly conveyed into the packaging by means of the conveyor belt, nor transferred into the packaging by means of known suction feeders or finger grippers. In the case of meat portions, such as those manufactured using an apparatus according to DE 297 23 638 U1 or DE 103 04 773 A1, for example, packing is therefore conducted by hand. However, packing by hand has the disadvantage of being both time-consuming and cost-intensive. Since a packer requires a certain amount of time to pack the items, several people are often required to perform packing when cycle times are high in order to ensure that the manufacture or processing of the items is not held up by slow packing.

THE INVENTION AND ITS ADVANTAGES

In contrast, the apparatus, according to the claimed invention, and the method, according to the claimed invention, have the advantage that the packing of the pliable items can be conducted by machine and at the same high cycle times as the manufacture or processing of the items. This means that the process is no longer held up by slow packing. Each of the items conveyed on the conveyor belt is pushed to the edge of the conveyor belt and subsequently from there onto a plate by a gripper, which is brought up to the item from behind. This may either be carried out at the lateral edge of the conveyor belt or at the back edge of the conveyor belt as viewed in the direction of transport close to the turn pulley. The plate and the gripper move the item into a position above its intended position in the package. The plate is then pulled out from underneath the item at high speed, whereupon it is returned to the conveyor belt in order to collect the next item. The gripper remains in position above the package either until the item's own weight causes the item to fall into the packaging or until the item is pushed into the packaging from above by a plunger. The advantage of the plunger is that it accelerates the process. The gripper is then returned to the conveyor belt in order to transport the next item into the packaging.

The item can be transferred from the conveyor belt to the plate either at the lateral edge of the conveyor belt or at the rear end of the conveyor belt as viewed in the direction of movement. The movement of the gripper must be adapted to the location at which this transfer is performed. If the item is pushed onto the plate at the side of the conveyor belt, then the plate can already have been partially moved beneath the conveyor belt. At the moment when the front end is pushed onto the plate, the plate is already in motion and carries the item away. If, in contrast, the item is pushed onto the plate at the end of the conveyor belt, then the full length of the conveyor belt is utilized. The rear section does not remain unused. The length of the conveyor belt can therefore precisely correspond to the distance required for the gripper to capture the items.

Once the gripper and the plate used to transport the item have reached the position above the package, the plate is pulled out from under the item to enable the item to fall into the packaging. The movement of the plate must be executed quickly enough to ensure that the item does not remain stuck to the plate due to its inertia. For this purpose, the plate is either rotated or displaced in a radial direction. The rotation is executed by the plate drive mechanism. As well as being pulled out from underneath the item, the plate is also simultaneously returned to its initial position at the conveyor belt. A second plate drive mechanism is provided in the event that the plate is to be displaced in a radial direction. The translational motion is combined with the rotational movement of the plate to enable the plate to be returned to its initial position as rapidly as possible.

It is not necessary to lift up the item at any point during its transfer from the conveyor belt into the packaging. This serves to accelerate the process. Moreover, the item is transferred onto the plate by the gripper so carefully that it is neither damaged nor impaired in terms of its quality. In this context, it is important to ensure that the physical and chemical properties of the conveyor belt surface are designed to ensure that the least possible friction arises between the item and the conveyor belt.

The layout of the items deposited in the packaging is influenced by the packaging conveyor system. The packaging conveyor system may comprise either a linear conveyor or a rotary conveyor. The packaging conveyor system may be single-axle or double-axle, allowing it to convey the packaging in either one or two directions. This means that the items can be deposited either in a single row or in multiple adjacent rows in a package. Moreover, further types of package transportation are possible. It is only necessary that the packaging conveyor system be adjusted to the movement of the individual items in terms of cycle times. The packaging is always transported onwards by a prescribed distance or a prescribed angle whenever an item has been deposited. As soon as a package has been completely filled with items, the full package is transported away, and an empty package is moved into place. The depositing of the items may be carried out in a fan-like or rosette-like configuration, for example.

According to an advantageous embodiment of the apparatus according to the invention, the gripper is provided with two fingers. One of these two fingers is permanently fixed in place on the gripper arm, while the other finger can alter its position in a radial direction. In a preferred embodiment, the finger arranged closer to the inside in a radial direction is mounted in a fixed position, while the outer of the two fingers in a radial direction is flexibly mounted to enable its position to be changed. According to a further, advantageous embodiment of the invention, a disk cam is provided in an off-center position with respect to the gripper arm's axis. The adjustable finger is connected to a cam roller, which, in the course of a rotation of the gripper arm, rolls over while frictionally locked to the stationary disk cam. The finger thus shifts its position in a radial direction dependent on the shape of the disk cam. This causes the outer finger to approach the inner finger whenever the gripper arm rotates over the conveyor belt. This ensures that an item conveyed on the conveyor belt is captured by the gripper regardless of its position. It is possible to achieve a lateral offset between the individually conveyed items due to the processing or handling of the items that has already been carried out.

According to a further advantageous embodiment of the invention, a gripper arm is rotated around its center. A gripper is positioned at each of the two opposing ends of the gripper arm. This allows the cycle times to be reduced further.

According to a further advantageous embodiment of the invention, both the gripper's fingers are rounded or beveled. This allows them to be adjusted to the shape of the items that are to be moved.

According to a further advantageous embodiment of the invention, the axis of the gripper arm drive mechanism and the axis of the plate drive mechanism run coaxially with respect to one another. Since the plate and the gripper arm execute different movements, two separate drive mechanisms are required. The plate is simply rotated back and forth around an angle, which is typically smaller or equivalent to 90°, between a first position immediately at the lateral edge of the conveyor belt and a second position above the packaging. In contrast, the gripper arm is swiveled in just one direction. If the arm is provided with two grippers, it must be swiveled 180° in order to pick up and deposit an item. Since it is necessary to harmonize the movements of the gripper arm and the plate and, in particular, perform the movements between the position at the edge of the conveyor belt and the position above the packaging simultaneously and without any lateral displacement, the coaxial nature of the axes is advantageous. The two axes run perpendicular and adjacent to the conveyor belt. Servomotors are particularly suitable as drive mechanisms for the gripper arm and the plate.

According to a further advantageous embodiment of the invention, a photoelectric beam is provided near the conveyor belt, which detects the passing of the rear end of the item at a prescribed point as viewed in the direction of transport. As soon as the item has passed this point, the gripper arm is rotated, thereby enabling the gripper to be brought up to the item from behind. In this process, the gripper arm is rotated in such a way that, upon reaching the item, it is moving at approximately the same speed as the conveyor belt. This ensures that the gripper only displaces the item laterally. Thus, the item is moved as little as possible relative to the surface of the conveyor belt.

The apparatus according to the invention and the method according to the invention can be used to not only transport and pack items of food, but also other items, particularly pliable items.

Further advantages and advantageous embodiments of the invention are to be taken from the drawing, the following description, and the claims.

DRAWING

The drawing shows an embodiment of an apparatus according to the invention. This embodiment is described in more detail below. The drawing comprises the following figures:

FIG. 1 Perspective view of the apparatus

Figure 2:
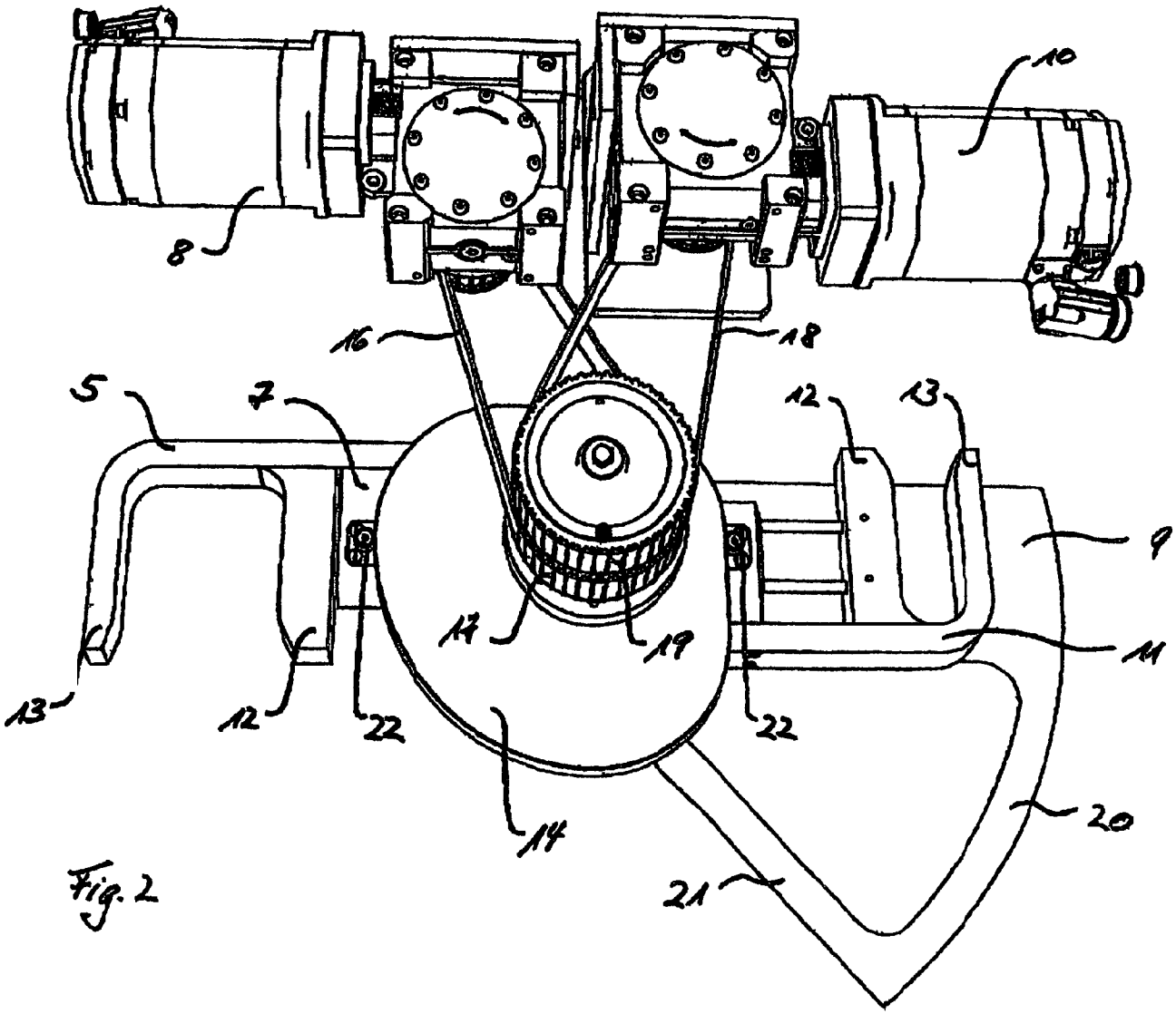
Figure 3:
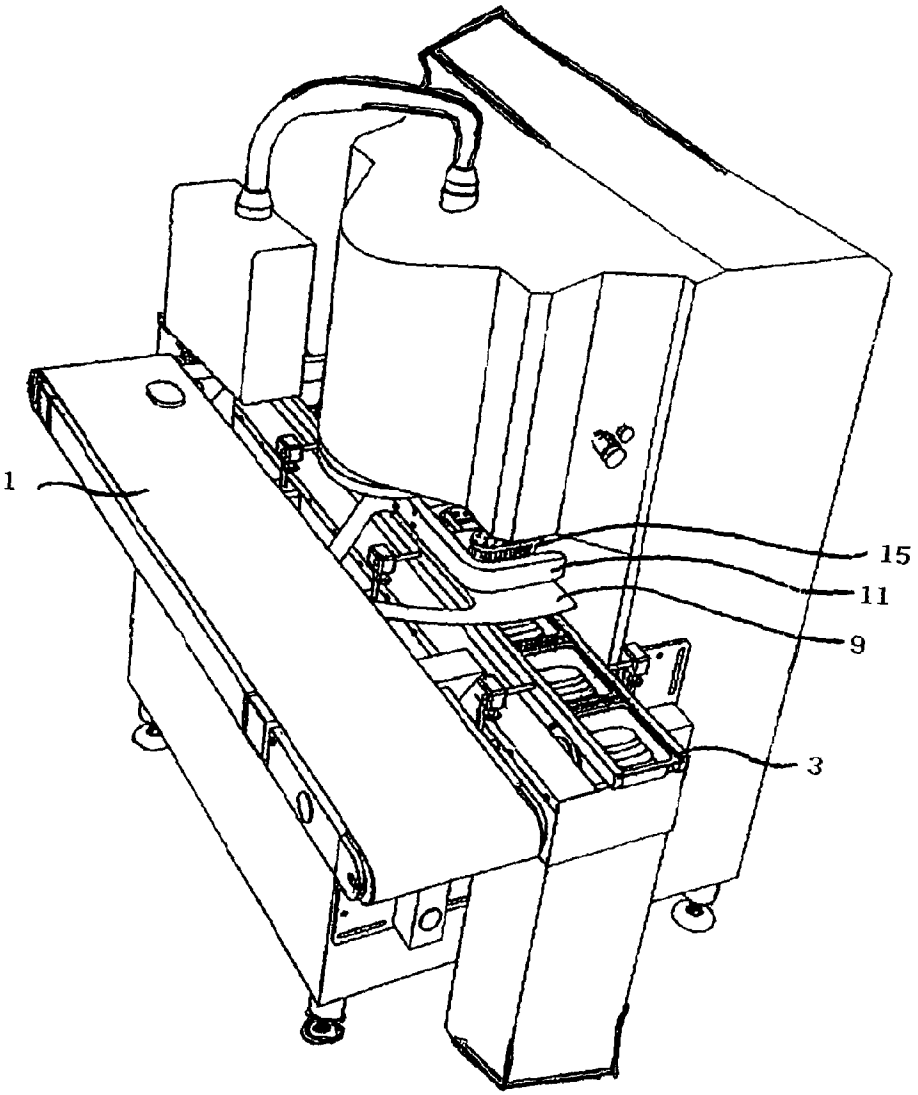

FIG. 2 Gripper arm and plate of the apparatus according to FIG. 1 with the corresponding drive mechanisms FIG. 3 Section of the apparatus according to FIG. 1 with conveyor belt, gripper arm, plate, and plunger.

DESCRIPTION OF THE EMBODIMENT

FIG. 1 shows an apparatus for the controlled depositing of pliable items in a package with conveyor belt 1, on which items 2 are conveyed, and packaging conveyor system 3, which brings up packages 4 and transports them onwards after the items have been deposited. The direction of transport of the conveyor belt is indicated by means of an arrow. Gripper 5 is arranged on a gripper arm that is not visible in FIG. 1. The gripper arm is concealed by casing 6 of the apparatus. Plate 9 receives items 2 from conveyor belt 1 and conveys them to a point above the intended position in package 4. A linear conveyer is shown as 25 and the photoelectric beam structure is 26.

FIG. 2 shows gripper arm 7, gripper arm drive mechanism 8, plate 9, and plate drive mechanism 10. Two grippers 5 and 11 are arranged on gripper arm 7. The gripper arm is rotated around an axis, which runs through its center, by means of gripper arm drive mechanism 8. This comprises a servomotor. The two grippers 5 and 11 each feature two fingers 12 and 13. The two inside fingers 12 as viewed in a radial direction are permanently fixed in place on the gripper arm. Their position does not alter in a radial direction during the rotation of the gripper arm. The two outer fingers 13 as viewed in a radial direction are attached to the gripper arm in a manner that allows their position to alter in a radial direction. This is achieved through the fact that fingers 13 are connected to cam rollers 22, which roll over while frictionally locked to stationary disk cam 14. In this process, cam rollers 22 follow the course of the disk cam. This motion is transferred to fingers 13. In the course of a 180° rotation of the gripper arm, the outer finger 13 of gripper 5 is initially located in a position whereby the distance between the two fingers 12 and 13 is at its maximum. With this distance between the two fingers, gripper 5 is swiveled over conveyor belt 1 in FIG. 1, so that it approaches item 2 from behind. In this process, finger 12 is located in close proximity to the lateral edge of conveyor belt 1, which faces packaging conveyor system 3. The distance between fingers 12 and 13 now begins to diminish as outer finger 13 is drawn radially inwards while gripper arm 7 rotates. Item 2 is captured in this process, regardless of the position it has taken on the conveyor belt. Moreover, it is drawn to the lateral edge of conveyor belt 1 by outer finger 13. As soon as it reaches the edge, it is pushed onto plate 9, which, at this point, is located close to the lateral edge of conveyor belt 1. Plate 9 and the gripper are then moved as a single unit at the same speed. This is indicated in FIG. 2 by second gripper 11 and plate 9. The common movement is continued until the position above the package is reached. Plate 9 is now moved at high speed in the opposing direction, thereby restoring it to its position close to the lateral edge of conveyor belt 1. Item 2's own weight now enables it to fall into the packaging. Item 2 and a package are not shown in FIG. 2. The downward motion is accelerated by plunger 15. Plunger 15 is shown in FIG. 3. The gripper arm then continues to rotate, thereby allowing the second gripper to capture a further item on the conveyor belt.

Gripper arm 7 and grip disk 14 are driven by gripper arm drive mechanism 8 via belt 16 and pulley 17. Plate 9 is driven by plate drive mechanism 10 via belt 18 and pulley 19. In this process, the axles, around which the gripper arm in the one case and the plate in the other case are driven, run coaxially. Both of the drive mechanisms comprise servomotors.

The width of plate 9 almost corresponds to the length of the two fingers 12 and 13 of grippers 5 and 11. To stabilize the plate, two braces 20 and 21 are provided, which, together with plate 9, form a circle segment.

FIG. 3 shows a section of the apparatus according to FIG. 1. Conveyor belt 1, packaging conveyor system 3, plate 9, gripper 11, and plunger 15 can all be seen in this view. While FIG. 1 features a perspective view in the direction of transport of the conveyor belt, FIG. 3 features a view opposite to the direction of transport.

All of the features of the invention may be key elements of the invention, both individually and in any combination with each other.

LIST OF REFERENCE NUMBERS

1 conveyor belt
2 item
3 packaging conveyor system
4 package
5 gripper
6 casing
7 gripper arm
8 gripper arm drive mechanism
9 plate
10 plate drive mechanism
11 gripper
12 inner finger of gripper
13 outer finger of gripper
14 disk cam
15 plunger
16 belt
17 pulley
18 belt
19 pulley
20 brace
21 brace
22 cam roller

The invention claimed is:

1. Apparatus for the controlled depositing of pliable items in a package a conveyor belt, on which the items are conveyed, a gripper on a rotating gripper arm, the axis of rotation of the rotating gripper arm runs perpendicular to the conveyor belt, whereby the gripper comes in direct contact with the items and pushes the items from the conveyor belt onto a plate, a gripper arm drive mechanism, which drives the rotation of the gripper arm, the plate, receiving the items from the conveyor belt and conveying the items to a point above the package, a plate drive mechanism to rotate the plate around an axis between a first position immediately next to the conveyor belt and a second position above the package, a package conveyor system, which conveys the packages and transports the packages onwards after an item has been deposited in order to allow the next item to be deposited.

2. Apparatus according to claim 1, wherein two fingers are provided on the gripper.

3. Apparatus according to claim 2, wherein one of the two fingers is connected to the gripper arm in a manner that allows it to be moved or adjusted in a radial direction with respect to a center point of the gripper arm and the other finger is permanently fixed in place on the gripper arm.

4. Apparatus according to claim 3, wherein a cam disk is provided in a position off-centered to the axis of rotation of the gripper arm, wherein the moved or adjusted finger is connected to a cam roller, and wherein the cam roller rolls in frictional engagement on the cam disk to move or adjust the finger.

5. Apparatus according to claim 2, wherein the two fingers of the gripper have ends which are one of rounded or beveled.

6. Apparatus according to claim 2, wherein the plate has a radial dimension measured relative to the axis of rotation of the plate, wherein the gripper arm and the fingers of the gripper have a combined radial dimension measured relative to the axis of rotation of the gripper arm, and wherein the radial dimension of the plate is no less than the combined radial dimension of the gripper arm and the fingers of the gripper.

7. Apparatus according to claim 1, wherein the gripper arm has opposing ends and is rotated around a center of the gripper arm, and wherein the gripper further comprises a plurality of grippers with one of said grippers arranged at each of the opposing ends of the gripper arm.

8. Apparatus according to claim 1, wherein the axis, around which the gripper arm is rotated by the gripper arm drive mechanism, and the axis, around which the plate is rotated by the plate drive mechanism, run coaxially with respect to one another.

9. Apparatus according to claim 1, wherein the plate drive mechanism displaces the plate in a radial direction with respect to a center point of the gripper arm.

10. Apparatus according to claim 1, wherein a servomotor is provided as a gripper arm drive mechanism and/or a plate drive mechanism.

11. Apparatus according to claim 1, wherein a photoelectric beam generating element is provided across the conveyor belt, which detects the passing of at least one end of the item.

12. Apparatus according to claim 1, wherein a vertically displaceable plunger is provided above the point at which the item is to be deposited in a package, and wherein said plunger presses the item into the package from above when the plate is returned to the first position immediately next to of the conveyor belt.

13. Apparatus according to claim 1, wherein the packaging conveyor system comprises a linear conveyor, which transports the packages forwards in cycles.

14. Apparatus according to claim 1, wherein the packaging conveyor system comprises a rotary conveyor, which rotates the packages in cycles.

15. Method for the controlled placing of pliable items in a package, comprising the steps of:

conveying the items on a conveyor belt, guiding each of the items with a gripper moving from an initial position to an edge of the conveyor belt, pushing each of the items with the gripper from the edge of the conveyor belt onto a plate;

conveying each of the items with the gripper and the plate to a point above an intended position in the package, moving the plate, out from under each of the item, and at a high speed and acceleration, from a first position beneath each of the items to a second position to allow each of the items to fall due to the weight of each of the items into the intended position in the package, returning the plate to the first position, and returning the gripper to the initial position to await a further item.

16. Method according to claim 15, further comprising the step of pressing the item into the package from above by a plunger.

17. Method according to claim 15, further comprising the step of rotating the gripper and the plate around two axes that extend coaxially with respect to one another.

18. Method according to claim 15, further comprising the step of passing the item through a photoelectric beam before the gripper guides the item.

19. Method according to claim 15, further comprising the step of moving the gripper at the same speed as the conveyor belt as soon as the gripper comes into contact with the item on the conveyor belt.

20. Method for the controlled placing of pliable items in a package, comprising the steps of:

conveying the items on a conveyor belt, guiding each of the items with a gripper moving from an initial position to an edge of the conveyor belt, the gripper having two fingers, pushing each of the items with the gripper from the edge of the conveyor belt onto a plate;

conveying each of the items with a gripper and the plate to a point above an intended position in the package, moving the plate, out from under each of the items, and at a high speed and acceleration, from a first position beneath each of the items to a second position to allow each of the items to fall due to the weight of each of the items into the intended position in the package, returning the plate to the first position, and returning the gripper to the initial position to await a further item.

* * * * *